US007758455B2

(12) United States Patent
Thomas

(10) Patent No.: US 7,758,455 B2
(45) Date of Patent: Jul. 20, 2010

(54) TENNIS TRAINING GRIP AND METHODS OF USE THEREOF

(76) Inventor: Carl A. Thomas, P.O. Box 1047, Lynnfield, MA (US) 01940

( * ) Notice: Subject to any disclaimer, the term of this patent is extended or adjusted under 35 U.S.C. 154(b) by 860 days.

(21) Appl. No.: 11/462,117

(22) Filed: Aug. 3, 2006

(65) Prior Publication Data

US 2008/0032832 A1 Feb. 7, 2008

(51) Int. Cl.
*A63B 69/38* (2006.01)
*A63B 49/08* (2006.01)

(52) U.S. Cl. ..... 473/459; 473/463; 473/551

(58) Field of Classification Search ..... 473/549, 473/551, 463, 459
See application file for complete search history.

(56) References Cited

U.S. PATENT DOCUMENTS 412,479 A * 10/1889 Davis ..... 264/271.1
1,917,236 A * 7/1933 Bloomstrand ..... 434/247
2,628,100 A * 2/1953 Beebe ..... 473/203
3,868,110 A * 2/1975 Jones ..... 473/551
3,905,598 A * 9/1975 Ballog ..... 473/538
D240,367 S * 6/1976 Cope ..... D21/756
4,006,896 A * 2/1977 Soldavini ..... 473/551
4,664,381 A * 5/1987 Aaron ..... 473/551
4,696,842 A * 9/1987 Doubt ..... 428/41.3
4,765,856 A * 8/1988 Doubt ..... 156/212
4,836,544 A * 6/1989 Lai ..... 473/551
4,934,024 A * 6/1990 Sexton ..... 16/421
4,943,058 A * 7/1990 Carbonetti ..... 473/551
5,238,620 A 8/1993 Wu et al.
5,403,008 A * 4/1995 Mainiero ..... 473/201
5,657,985 A * 8/1997 Dahlstrom et al. ..... 473/523
5,692,265 A * 12/1997 Dalury ..... 16/430
5,924,941 A * 7/1999 Hagey ..... 473/551
5,984,795 A 11/1999 Stafford
7,276,000 B1 * 10/2007 Baker ..... 473/549
2008/0032832 A1 * 2/2008 Thomas ..... 473/459

OTHER PUBLICATIONS

"What-a-grip" Tennis Overgrip, (Downloaded on Aug. 2, 2006) http://www.holabirdsports.com/cgi-bin/product?product=061200.

* cited by examiner

*Primary Examiner*—Raleigh W. Chiu
(74) *Attorney, Agent, or Firm*—Antoinette G. Giugliano, PC

(57) ABSTRACT

The present invention relates to a training grip for a tennis racket. The training grip has a series of protrusions and recesses that receive a user's hand and place it in proper position for a particular grip type. The present invention, in one embodiment, includes a universal training grip that allows the grip to be used for more than one grip type. The present invention includes methods, systems and kits that encompass such a tennis training grip.

18 Claims, 8 Drawing Sheets

TENNIS TRAINING GRIP AND METHODS OF USE THEREOF

BACKGROUND OF THE INVENTION

Tennis has proven, for many, to be a difficult sport to master. Often a player can improve their tennis game by utilizing the proper grip for certain strokes, such as the forehand, backhand, volley, and serve. Although players may understand, in theory, where their hand should be positioned for certain strokes, it is many times difficult to execute.

Hence, a need exists for a teaching tool that allows for a tennis player to execute a stroke using the proper grip. A further need exists for a universal training tool that can be used to teach the necessary grip for various types of stokes.

SUMMARY OF THE INVENTION

The present invention relates to a training grip for a tennis racket. The training grip includes an annular elongated member, for positioning over a preexisting grip of a tennis racket handle, and at least one opening, positioned at the top end, to allow for extrusion of the tennis racket head. The training grip also includes at least two contoured protrusions (e.g., two, three, four, five, six, seven, eight, nine, ten, eleven, or twelve) extending from the annular elongate member, and at least two contoured recesses (e.g., two, three, four, five, six, seven, eight, nine, or ten) defined in the annular elongate member. The protrusions and recesses are contoured and positioned for guiding fingers of a hand of a tennis player into a proper grip. The annular elongated member, when placed on the tennis racket handle, has an inner diameter of between about 3 cm and about 6 cm. The training grip can be aligned in more than one position for use in more than one grip type. In a preferred embodiment, the training grip has about six protrusions and about five recesses for guiding fingers of a hand of a tennis player for a proper grip. The training grip can be made from, in part or in whole, a non-slip material, or have a textured inner surface, to prevent slippage. When gripped by a tennis player, the inner diameter of the player's grip does not change by more than about 1 cm. The training grip of the present invention can optionally include a lengthwise slit that extends, partially or fully from the top end to the bottom end. The lengthwise slit has a width of between about 0.5 cm and about 2.5 cm. The training grip can be aligned in more than one position for use in more than one grip type. The alignment can be accomplished, in an embodiment, by rotating the training grip clockwise or counterclockwise until the training grip is in the desired position. Additionally, an embodiment of the present invention includes a training grip with markings (e.g., symbols, letters or words) to illustrate positioning of a training grip for a desired grip type. The present invention further includes grip tape or elastic band having markings to illustrate positioning of the training grip. The grip tape or elastic band with these markings is wrapped around or applied to the top of the handle of the tennis racket.

The present invention also embodies tennis training grip systems and kits. The systems and/or kits include one or more training grips, as described herein, one or more tennis rackets, or a combination thereof. The tennis racket handle can have markings (e.g., symbols, letters or words) to illustrate positioning of a training grip for a grip type such as a forehand stroke, a backhand stroke, a serve or combination thereof. The systems and kits of the present invention, in another embodiment, include the training grip described herein, and grip tape having markings thereon to illustrate positioning of the training grip for a grip type (e.g., a grip for a forehand stroke, a backhand stroke, and/or a serve). In yet another embodiment, the kits and systems include a series of tennis training grips, each used for a specific grip type or specific size grip.

The present invention includes methods for hitting a tennis ball with a tennis racket having a tennis racket head and a tennis racket handle. The methods include placing the training grip, as described herein, on tennis racket handle and aligning the grip for a type of tennis stroke (e.g., a backhand, forehand, volley, or serve), gripping the racket as guided by the aligned grip, and hitting a tennis ball with the type of tennis stroke. The method further includes realigning the grip for another type of tennis stroke.

Methods of the present invention also include methods for attaching a tennis training grip to a tennis racket for use in executing a tennis stroke. The methods involve placing a training grip, as described herein, on a tennis racket handle and aligning the grip for a type of tennis stroke, wherein the type of tennis stroke is a backhand, forehand or serve.

The tennis training grip of the present invention has several advantages. The training grip uniquely allows a player to experience hitting a particular stroke with the proper grip. The training grip of the present invention allows a player to repeatedly execute the stroke with their hand in the proper grip position. Such repetition increases a player's muscle memory by allowing them to learn by hitting the shot properly, as opposed to trial and error. Additionally, the training grip, in an embodiment, is universally designed to accommodate more than one grip type simply by rotating the training grip into position.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

FIG. 3A1 is a detailed view of the grip tape with alignment markings on it.

DETAILED DESCRIPTION OF THE INVENTION

A description of preferred embodiments of the invention follows.

Figure 1A:
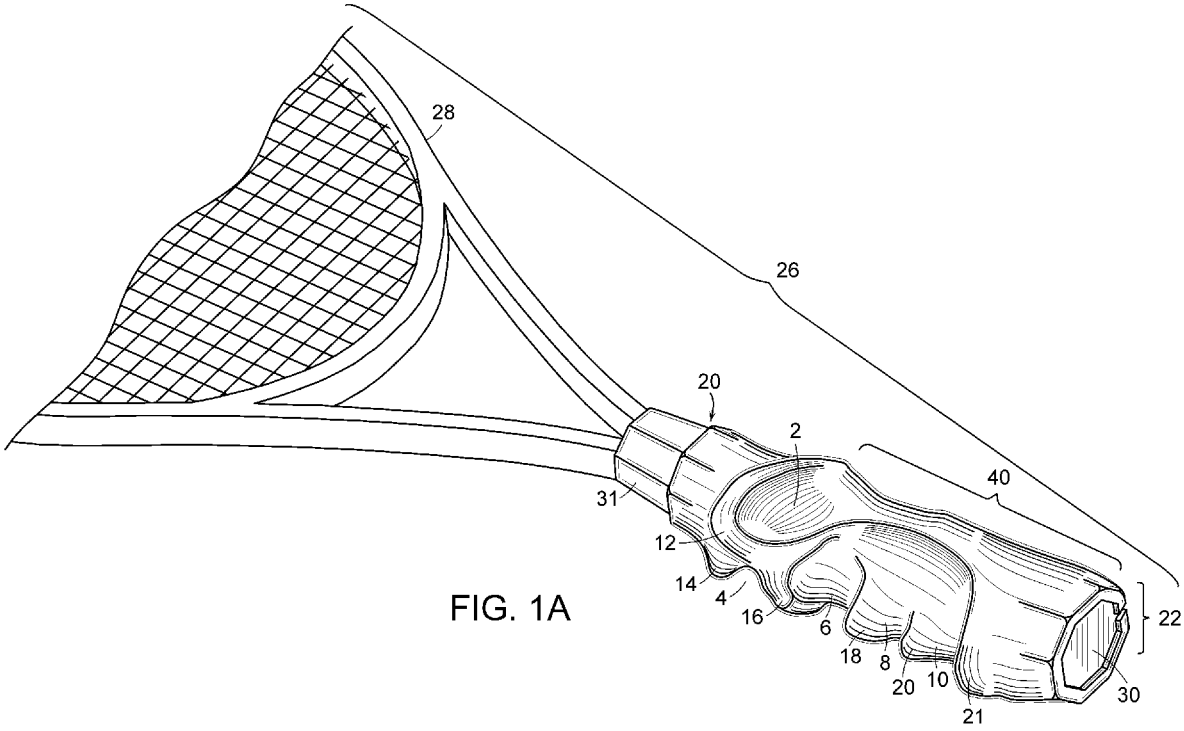
FIG. 1A is a perspective view of the front side of the tennis training grip of the present invention positioned on a tennis racket handle.
Figure 1B:
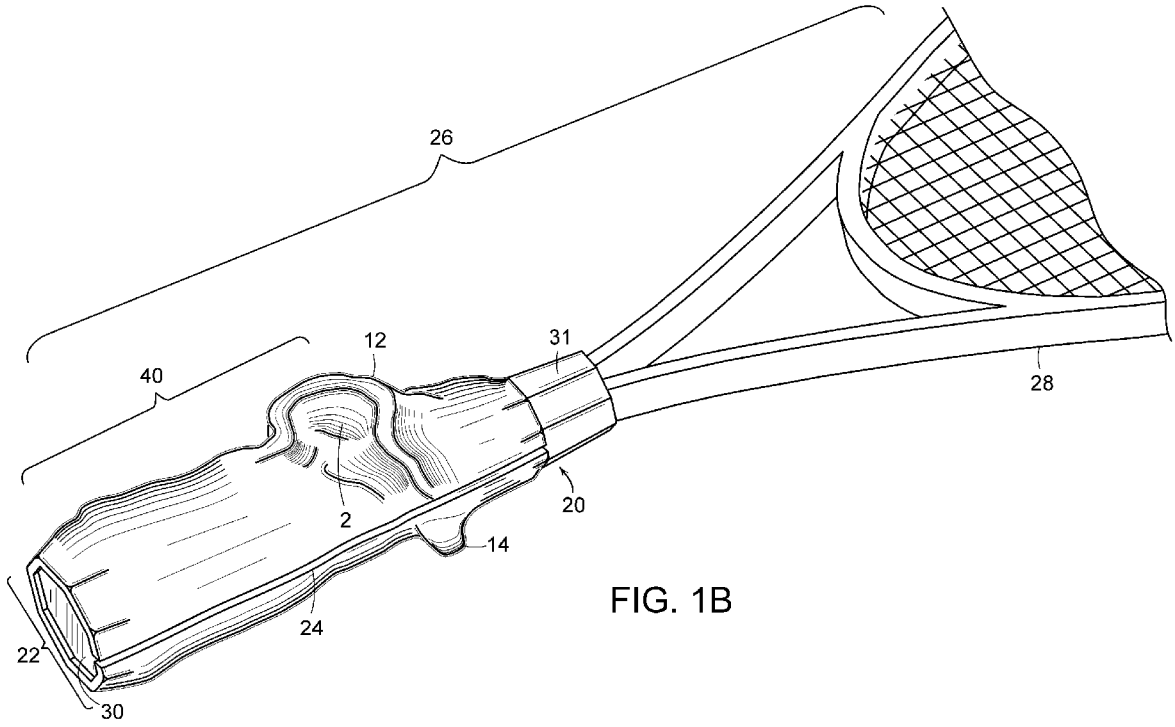
FIG. 1B is a perspective view of the back side of the tennis training grip of the present invention positioned on a tennis racket handle.

The present invention relates to a tennis teaching grip (e.g., referred to herein as a "training grip"). A common problem with a player's stroke is an improper grip. Having a proper grip for the desired stroke often assists in better execution of the stroke. Referring to FIGS. 1A and 1B, training grip 40 is positioned over a preexisting grip of handle 30 of tennis racket 26. Training grip 40 has a plurality of protrusions and recesses. The combination of protrusions and recesses receive the fingers of a player's hand so that the hand is in a proper or preferred grip position for a certain type of stroke. The embodiment shown in FIG. 1A shows a configuration of six protrusions, protrusion 12, 14, 16, 18, 20 and 21 and five recesses, recess 2, 4, 6, 8 and 10. In particular, recess 2, 4, 6, 8, and 10 receives the thumb, index figure, middle finger, ring finger, and pinky finger, respectively. The present invention has at least two recesses and corresponding protrusions, contoured to receive a user's thumb and index finger. In such an embodiment, the rest of the fingers of the users hand will naturally fall into place. Consequently, the present invention includes a training grip with at least two recesses to receive a user's thumb and index finger, and up to five recesses (e.g., 2, 3, 4, or 5 recesses). Use of the training grip of the present invention enhances the user's muscle memory and allows the user to perfect the desired stroke.

A proper grip position depends on a number of factors, including, for example, the type of stroke being executed (e.g., forehand, backhand, serve, volley, etc.), the speed of the ball, and placement of the ball, the stroke style of the player, the positioning of the ball and the racket at the time of impact, and other factors generally known in the art. A "proper" grip position is a position that is generally accepted in the art as being appropriate or advantageous for the particular stroke being executed. Examples of types of tennis grips include the Continental Forehand Grip, Eastern Forehand grip, Semi-Western Forehand Grip, Western Forehand Grip, Hammer Grip, Continental Backhand Grip, Eastern Backhand Grip, and Full Eastern Backhand Grip. Training grip 40 can be aligned to guide the player's hand to use any one of these grips, and other grips known in the art or those later developed. Training grip 40 is aligned by rotating the grip clockwise or counterclockwise around the handle, as further described herein and shown in FIG. 3.

The contours of the protrusions and recesses guide the player's hand in a proper grip position. As shown in FIGS. 1A, 1B, 2A, 2B, 2C, and 2D training grip 40 positions the player's hand to optimize their stroke. For example, recess 2, which receives a player's thumb is angled forward toward the racket head 28, and recess 4 which is designed to receive the player's index finger is slightly separated from the rest of the recesses (recess 4, 6, and 10) that receive the other fingers, namely the middle finger, ring finger and pinky finger. This slight separation is accomplished by protrusion 16, which is slightly larger than protrusions 18, 20 and 21. The combination of these recesses and protrusions provide contours that guide the hand into a preferred position.

These recesses and protrusion can be modified to fit different size hands, different style of players, various types of strokes, or to achieve certain types of shots (e.g., adding top spin, drop shots, volleys, flat shots, etc.). For example, a training grip made for a larger hand can have a larger protrusion that separates the thumb and index finger, and a larger protrusion between the index finger and the middle finger. In the same manner, a training grip for a small hand (e.g., a child, teen or small adult) can have smaller protrusions and recesses.

In another example, the training grip can be modified according to the desired grip. For example, a training grip that is designed to teach a hammer grip can be designed with a smaller protrusion between the index finger and the middle finger. A hammer grip is known as a tight-fisted continental grip and is similar to how one would hold a hammer. It can be for serves, volleys and overheads. In yet another embodiment, the training grip of the present invention can be modified for a two-handed backhand grip. The training grip can have additional recesses and protrusions for some or all of the fingers of a second player's hand. In an embodiment, training grip 40 can be modified to add 5 additional recesses and 6 additional protrusions underneath the existing recesses and protrusions, but placed in the opposite direction. The additional recesses and protrusions can mirror the existing ones, but positioned to allow the player to grab the racket handle with the other hand. The existing recesses and protrusions can be placed closer together to allow room for a second grip by the a second player's hand.

Figure 2A:
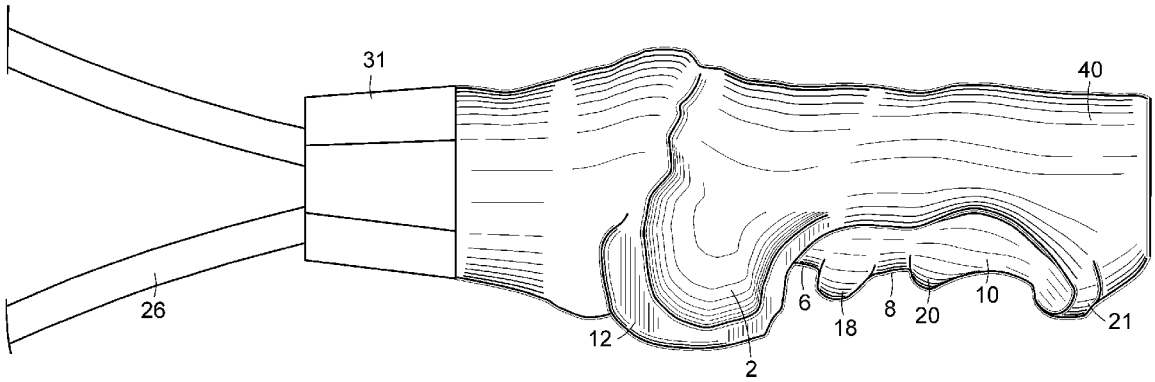
FIG. 2A is a side view of the thumb side of the tennis training grip of the present invention.
Figure 2B:
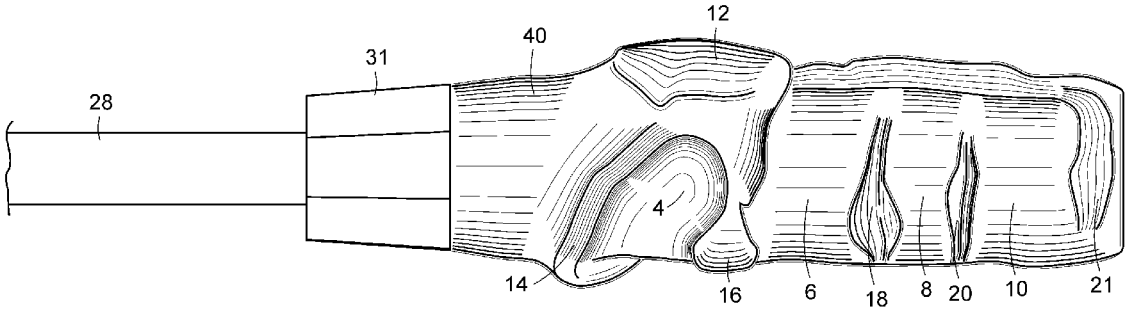
FIG. 2B is a side view of the tennis training grip, turned clockwise 90° from the view shown in FIG. 2A.
Figure 2C:
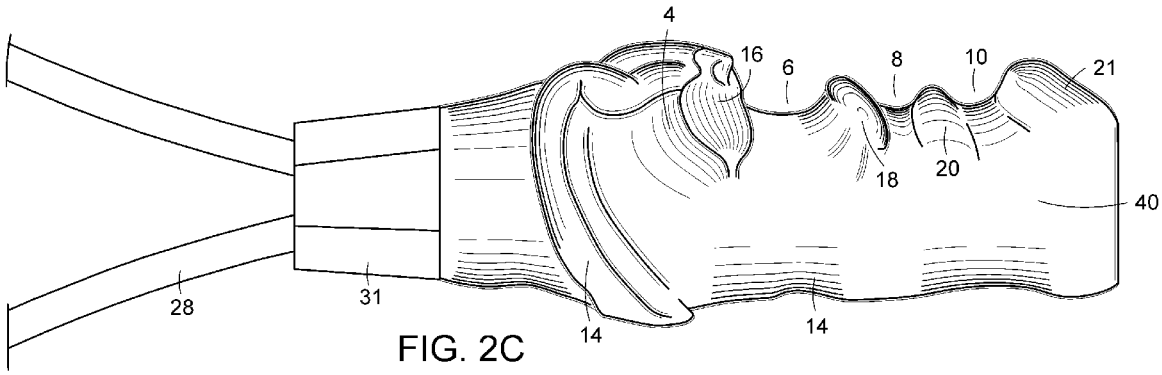
FIG. 2C is a side view of the tennis training grip, turned clockwise 180° from the view shown in FIG. 2A.
Figure 2D:
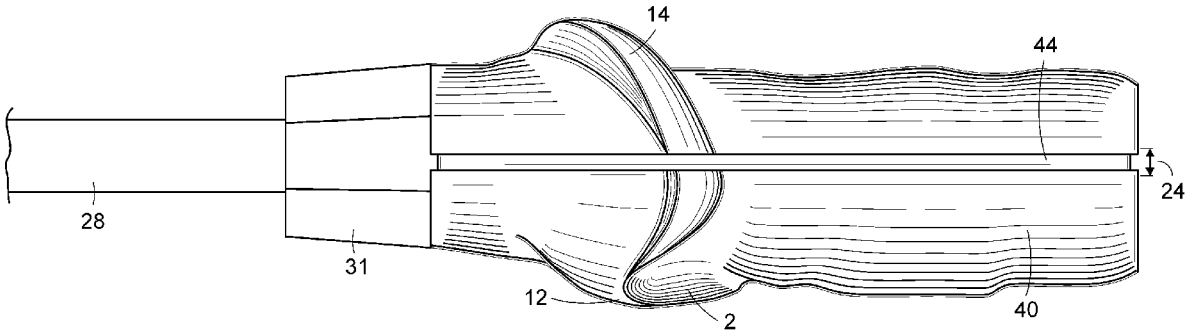
FIG. 2D is a side view of the tennis training grip, turned clockwise 270° from the view shown in FIG. 2A.
Figures 1, 3A:
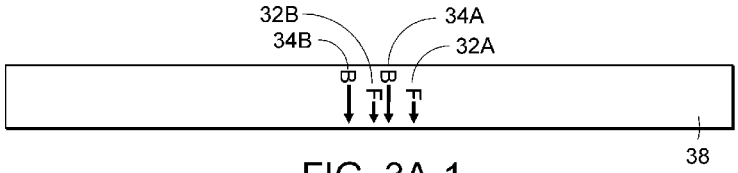
Figure 3A:
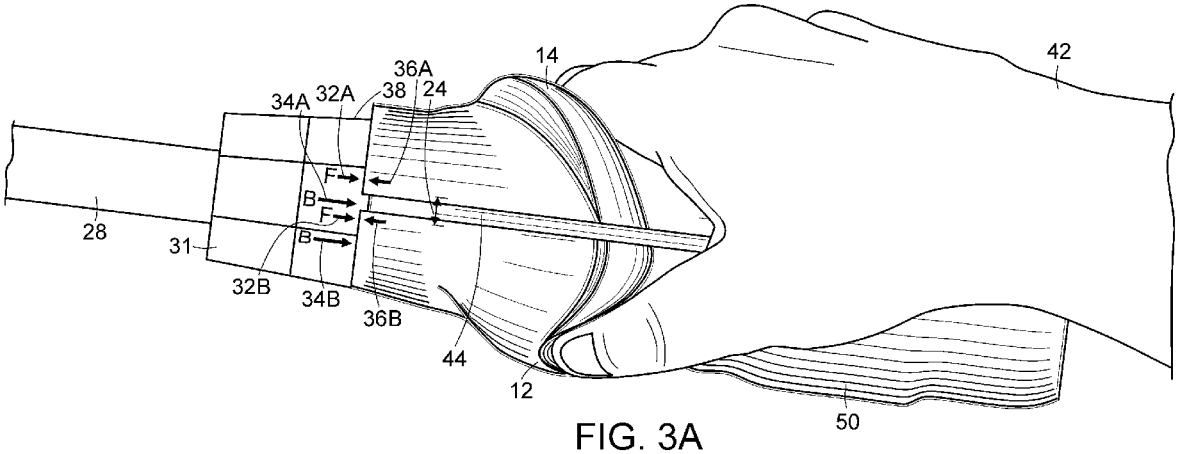
FIG. 3A is a perspective view of a player's hand in an Eastern forehand grip position using another embodiment of training grip of the present invention.

Training grip 40 shown in FIGS. 1 and 2 is designed for a right-handed player. However, the present invention includes an embodiment for a training grip having the mirror image of the recesses and protrusions, suitable for a left-handed player.

Training grip 40 has opening 20 that allows for the extrusion of tennis racket head 28, and second opening 22 that meets the but of handle 30. A second opening at the but of the handle is optional, and instead can have a cap that covers the but of the racket. In FIG. 1B and 2D which shows the back side of training grip 40, slit 24 that runs lengthwise along handle 30 can be seen. Such a slit allows for the user to pry open the training grip and position the training grip around a tennis racket handle, and further allows for the user to align the training grip in the desired position for the particular type of grip to be utilized for the stroke. The slit can extend along the entire length of the grip, or a portion of the grip, so long as the user can position the grip around the tennis racket handle. Such a slit can have a width opening of between about 0.2 cm and about 2.5 cm. Another embodiment of the training grip does not have a slit, but instead uses an elastic material that is stretched over handle 30 into the desired position.

Generally, grip sizes range from 441 for juniors to 4⅝" for a large adult hand, as measured from the middle palm crease to the tip of the ring finger. This measurement of grip size translates into a diameter having a distance ranging between about 3 cm and about 5.5 cm. This diameter is measured at the outer surface where a player typically grips a tennis racket handle. Hence, the inner diameter of the training grip ranges from about 3 cm to about 6 cm.

Furthermore, the training grip of the present invention is designed so as not to change to a great extent the inner diameter of the player's grip. Although the thickness of the protrusions of the training grip of the present invention is greater, the thickness of the recesses of the grip is minimal, e.g., between about 1 mm (or less) and about 1 cm. The outer diameter of training grip 40 at the recesses is slightly greater than the outer diameter of pre-existing grip 44 of the racket handle. Hence, when a player is using the training grip of the present invention, the overall diameter of the player's grip does not change by more than about 1 cm, and preferably not more than 2 mm or less.

The training grip of the present invention is preferably made from a resilient material such as an elastomeric or similar compound. Material used for the training grip has adhesive or frictional property to prevent slippage or twisting of the grip or the user's hand when grasping the training grip and/or during execution of a stroke. The material preferably has flexibility sufficient to allow a user to place the grip on a tennis racket handle. The material should be stiff enough to maintain the protrusions during use, and also thin at the recesses so as not to significantly change the diameter of the grip, as described herein. Examples of material used for training grip 40 include rubber material, elastic or expandable material, nylon fabrics, synthetic fibers, foam, cloth, and blends, composites and combinations thereof Any material known in the art or later developed can be used to make the training grip of the present invention. In an embodiment, techniques that can be used to manufacture the grip include extrusion molding, and other techniques known to those skilled in the art to provide a preferable one-piece construction.

The training grip of the present invention preferably does not slip when in use. Use of a non-slip material or surface can be used (e.g., an adhesive material). In an embodiment, the inner surface of the training grip can have a non-slip quality, characteristic or texture. Examples of non-slip textured characteristics include a plurality of studs, treads, grating, ribbing, or the like. Other textured surfaces known in the art or later developed can be used. The textured surface can also form a logo or design on the inside surface. The textured surface can be spaced throughout the inner surface of the training grip, or attached to portions of the inner surface likely to exhibit greater force during execution of the stroke than other portions.

Figure 3B:
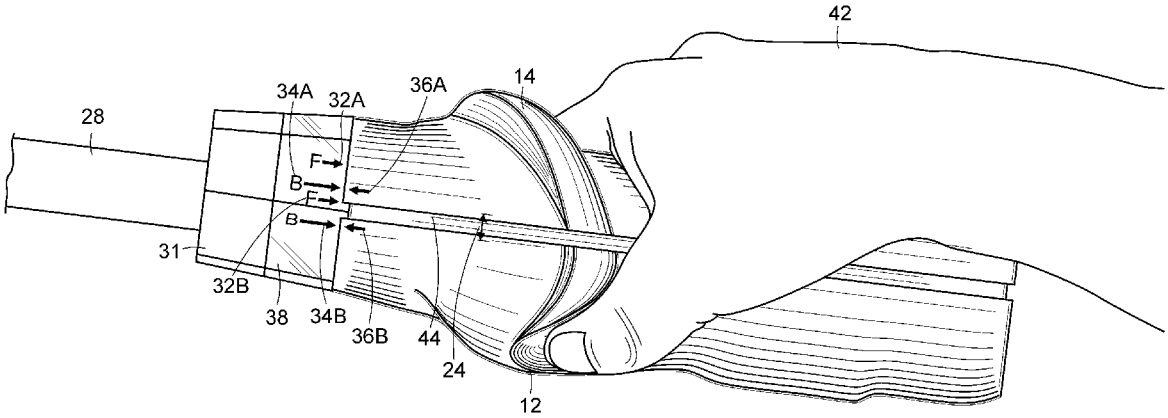
FIG. 3B is a perspective view of a player's hand in an Eastern backhand grip position using an embodiment of training grip of the present invention.
Figure 3C:
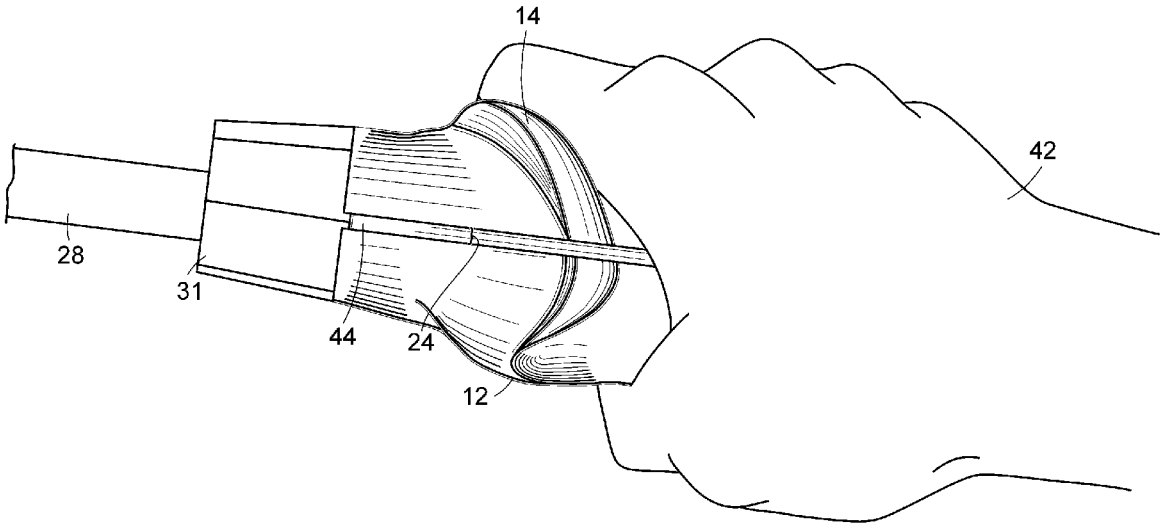
FIG. 3C is a perspective view of a player's hand in Continental Forehand grip position using another embodiment of training grip of the present invention.

FIGS. 3A, 3B and 3C show the present invention utilized for various types of grips. For some grips, the positioning of the fingers, relative to one another stay essentially the same. Hence, in an embodiment, a single training grip can be universally used for multiple grip types and aligned by rotating the grip, clockwise or counterclockwise, into the proper grip position. Examples of grips in which the finger positioning is the same are the Eastern forehand grip and the Eastern backhand grip. The difference between these two grip types is the position of the hand, relative to the racket handle. Training grip 50 is aligned clockwise or counterclockwise around racket handle 30 to place the hand in one of these two grips. FIG. 3A shows a player in an Eastern forehand grip, and FIG. 3B is an example of an Eastern backhand grip. The hand, relative to the racket handle, is rotated to be aligned into proper position.

The alignment is aided by forehand marking 32A and 32B on tape 38. Backhand markings 34A and 34B are also present and aid in the alignment of the Eastern backhand grip, as shown in FIG. 3B. Alignment markings can be placed on tape that is attached by the user, or on the tennis racket handle itself. Alignment markings can be any word, letter, or symbol that allows for the identification of the alignment of the training grip. Training grip 50 has grip markings 36A and 36B that complement markings on grip tape 39, as shown in FIGS. 3A and 3B.

In an embodiment in which no markings appear on the training grip, the irregular octagon shape at the top of the racket handle, can be used as a guide for aligning the training grip of the present invention. In FIG. 3A, instead of using the markings, the user can align slit 24 with the middle portion of a side of the octagon 31, namely the side in line with the racket head frame. Similarly, the backhand grip shown in FIG. 3B, can be rotated counterclockwise so that slit 24 is aligned with the edge of the same side of octagon 31. Conversely, the Continental Forehand Grip, commonly used in serves and volleys, shown in FIG. 3C, is rotated clockwise so that slit 24 is aligned with the other edge of the same side of octagon 31.

In another embodiment, the training grip of the present invention includes a set or plurality of training grips. In this embodiment one training grip can be used for a specific grip type, e.g., a training grip for a continental grip, another training grip for western grip, etc. Such a training grip, in an embodiment, has an inner portion that complements the irregular octagon shape of the handle so it fits in one of two positions, one position being a mirror image of the other. Also the grip series can have alignment markings as described herein. Alternatively, a series of tennis rackets has the training grip permanently affixed thereto or otherwise integrated with the racket are encompassed by the present invention. For example, a forehand racket can be sold with the training grip permanently attached thereto. As such, the present invention encompasses a series of tennis rackets having a non-removable training grip, each for a specific grip type (e.g., a forehand racket, a backhand racket and a serving racket).

The present invention also includes methods of installing the training grip and methods of using the training grip. To install the training grip on the tennis racket, a player or instructor places the training grip over the racket handle. If the training grip includes a slit, the slit can be pried open and placed over the handle. If the training grip does not include a slit, but is made from an expandable or elastic material that can be stretched over the handle, then the user stretches the grip and slides it over the handle using opening 20. The grip is then aligned for a specific grip type for the desired stroke. The alignment can occur simultaneously as the grip is being placed on the handle, or adjusted after placement on the handle. Using training grip 40 or training grip 50, the user aligns the grip by rotating the grip clockwise or counterclockwise until the desired position is reached. In an embodiment in which marking are included on the racket or on grip tape, as described herein, the user aligns the racking in accordance with the markings. The methods further include attaching the grip tape having alignment markings around the top of the tennis racket handle.

Once the training grip is properly aligned on the tennis racket handle, the player can grip the training grip by placing their fingers in the corresponding recesses, e.g., recesses 2, 4, 6, 8, and 10. The player can then execute the desired stroke using the proper grip (e.g., an Eastern Forehand Grip) as guided by the training grip. The training grip demonstrates to the player how to properly grip the racket by allowing the player to experience the feel of a proper grip. Repetition of the desired stroke (e.g., a forehand ground stroke) using the proper grip as dictated by the training grip of the present invention increases muscle memory of the player and improves their ability to hit the ball. In an embodiment, these steps can be repeated for different grip types (e.g., an Eastern Backhand Grip) and different strokes (e.g., a backhand ground stroke) by simply realigning the grip into the desired position.

The present invention also includes tennis training grip systems and kits. Such systems and kits include the training grip, as described herein, along with one or more tennis rackets, grip tape, grip elastic, additional training grips (e.g., two or more total training grips), other tennis related items, or any combination thereof. Tennis rackets, grip tape and training grips can optionally have the alignment markings as described herein. In another embodiment, a series of training grips can be sold, one training grip for each type of grip type, each with markings to indicate the grip type. Additionally, tennis rackets having the training grips already attached thereto are encompassed by the present invention. The training grips can be pre-aligned on the tennis racket, and can be removable or essentially permanently attached thereto. In yet another embodiment, the training grip can be attached to the tennis racket so that it can be rotated into proper position for the desired grip, but not readily removably from the tennis racket (e.g., the training grip is attached at the but of the tennis racket handle with a string or other mechanism that prevents the user from sliding the grip off the tennis racket).

EXEMPLIFICATION

The training grip, as shown in FIGS. 1 and 2, was constructed for use on a 4⅜" size (size No. 3) racket handle. The training grip, that was construction, has a length of about 17 cm, an inner diameter of about 4.25 cm, and an outer diameter including the edge of the largest protrusion (the protrusion that surrounds the recess for the thumb) of about 7 cm. The training grip was made with six protrusions, protrusions 12, 14, 16, 18, 20, and 21 and five recesses, recesses 2, 4, 6, 8, and 10. Protrusion 12 and 21 are continuous. The largest protrusion for the thumb, protrusion 12, has a height of about 2 cm from the annular member, whiles the smallest protrusion, protrusion 20 has a height of about 0.5 cm. The thickness of between the inner surface of the training grip and the outer surface of recesses of the fingers averaged about 2 mm, but is preferably less.

The training grip was used to hit forehand strokes, back hand strokes and serves. The training grip was aligned into for various grip types including the following grips: Continental Forehand Grip, Eastern Forehand grip, SemiWestern Forehand Grip, Western Forehand Grip, Hammer Grip, Continental Backhand Grip, Eastern Backhand Grip, full and Eastern Backhand Grip. The training grip, when aligned, allowed the user to maintaining proper grip position during execution of the stroke.

The training grip was molded from a pliable material to achieve the contours necessary to achieve the proper grip position.

The relevant teachings of all the references, patents and/or patent applications cited herein are incorporated herein by reference in their entirety.

While this invention has been particularly shown and described with references to preferred embodiments thereof, it will be understood by those skilled in the art that various changes in form and details may be made therein without departing from the scope of the invention encompassed by the appended claims.

What is claimed is:

1. A training grip for a tennis racket, said tennis racket having a tennis racket head and a tennis racket handle, wherein the training grip comprises:

a. an annular elongated member, for positioning over a preexisting grip of a tennis racket handle, said annular elongated member having a top end and a bottom end;

b. at least one opening, positioned at the top end, to allow for extrusion of the tennis racket head;

c. at least two contoured protrusions extending from said annular elongate member, d. at least two contoured recesses defined in said annular elongate member; and e. training grip markings that comprise symbols, letters or words, wherein the training grip markings are used with grip tape markings that are placed around the tennis racket handle, wherein the training grip markings and the grip tape markings are aligned to illustrate positioning of more than one grip type; and wherein the annular elongated member, when placed on the tennis racket handle, has an inner diameter of between about 3 cm and about 6 cm.

2. The training grip of claim 1, wherein the training grip can be aligned in more than one position for use in more than one grip type.

3. The training grip of claim 1, further including about six protrusion and five recesses for guiding fingers of a hand of a tennis player for a proper grip.

4. The training grip of claim 1, wherein the training grip is made from a non-slip material.

5. The training grip of claim 1, wherein, when gripped by a tennis player, the inner diameter of the player's grip does not change by more than about 1 cm.

6. The training grip of claim 1, further having a lengthwise slit that extends from the top end to the bottom end.

7. The training grip of claim 6, further including a lengthwise slit that has a width of between about 0.5 cm to about 2.5 cm.

8. A training grip for a tennis racket, said tennis racket having a tennis racket head and a tennis racket handle, wherein the training grip comprises:

a. an annular elongate member, for positioning over a preexisting grip of a tennis racket handle, said annular elongate member having a top end and a bottom end;

b. at least one opening, positioned at the top end, to allow for extrusion of the tennis racket head;

c. a lengthwise slit that extends from the top end to the bottom end;

d. about six protrusions extending from said annular elongate member, e. about five contoured recesses defined in said annular elongate member; and f. training grip markings that comprise symbols, letters or words, wherein the training grip markings are used with grip tape markings that are placed around the tennis racket handle, wherein the training grip markings and the grip tape markings are aligned to illustrate positioning of more than one grip type; and wherein the protrusions and recesses are contoured and positioned for guiding fingers of a hand of a tennis player for a proper grip, and wherein the training grip can be aligned in more than one position for use in more than one grip type.

9. The training grip of claim 8, wherein the training grip is made from a non-slip material.

10. A tennis training grip system, the system comprises:

a. a tennis racket having a tennis racket head, a tennis racket handle and grip tape, for placement around the tennis racket handle, having markings to illustrate positioning of said training grip;

b. a training grip having:

i. an annular elongate member, for positioning over a preexisting grip of a tennis racket handle, said annular elongate member having a top end and a bottom end;

ii. at least one opening, positioned at the top end, to allow for extrusion of the tennis racket head;

iii. at least two contoured protrusions extending from said annular elongate member, and iv. a plurality of contoured recesses defined in said annular elongate member.

11. The system of claim 10, wherein the markings on the handle to illustrate positioning of a training grip comprise symbols, letters or words.

12. The system of claim 11, wherein the markings convey grip position for a forehand stroke, a backhand stroke, a serve or combination thereof.

13. A tennis training grip system for a tennis racket, said tennis racket having a tennis racket head and a tennis racket handle, wherein the tennis training grip system comprises:

a. a training grip having:

i. an annular elongate member, for positioning over a preexisting grip of a tennis racket handle, said annular elongate member having a top end and a bottom end;

ii. at least one opening, positioned at the top end, to allow for extrusion of the tennis racket head;

iii. at least two contoured protrusions extending from said annular elongate member, and iv. a plurality of contoured recesses defined in said annular elongate member; and b. grip tape, for placement around the tennis racket handle, having markings to illustrate positioning of said training grip.

14. The system of claim 13, wherein the markings comprise symbols, letters or words.

15. The system of claim 14, wherein the markings convey grip position for a forehand stroke, a backhand stroke, a serve or combination thereof

16. A method for hitting a tennis ball with a tennis racket having a tennis racket head and a tennis racket handle, the method comprises:

a. placing a training grip on said tennis racket handle; wherein the training grip comprises:

i. an annular elongate member, for positioning over a preexisting grip of a tennis racket handle, said annular elongate member having a top end and a bottom end;

ii. at least one opening, positioned at the top end, to allow for extrusion of the tennis racket head;

iii. at least two contoured protrusions extending from said annular elongate member, and iv. a plurality of contoured recesses defined in said annular elongate member;

b. aligning the grip for a type of tennis stroke, wherein the type of tennis stroke is a backhand, forehand or serve;

c. gripping the racket as guided by the aligned grip;

d. hitting a tennis ball with the type of tennis stroke; and e. realigning the grip for another type of tennis stroke.

17. A method for attaching a tennis training grip to a tennis racket for use in executing a tennis stroke, the method comprises:

a. placing a training grip on said tennis racket handle; wherein the training grip comprises:

i. an annular elongate member, for positioning over a preexisting grip of a tennis racket handle, said annular elongate member having a top end and a bottom end;

ii. at least one opening, positioned at the top end, to allow for extrusion of the tennis racket head;

iii. at least two contoured protrusions extending from said annular elongate member, and iv. a plurality of contoured recesses defined in said annular elongate member;

b. aligning the grip for a type of tennis stroke, wherein the type of tennis stroke is a backhand, forehand or serve; and c. realigning the grip for another type of tennis stroke.

18. A tennis training grip kit; the kit comprises:

a. a training grip having:

i. an annular elongate member, for positioning over a preexisting grip of a tennis racket handle, said annular elongate member having a top end and a bottom end;

ii. at least one opening, positioned at the top end, to allow for extrusion of the tennis racket head;

iii. at least two contoured protrusions extending from said annular elongate member, and iv. a plurality of contoured recesses defined in said annular elongate member;

b. grip tape having marking thereon to illustrate positioning of said training grip; and c. a tennis racket.

* * * * *